US006698615B2

(12) United States Patent
Knightlinger

(10) Patent No.: US 6,698,615 B2
(45) Date of Patent: Mar. 2, 2004

(54) GOLF TEE HOLDER AND DISPENSER

(76) Inventor: Thomas Dee Knightlinger, 8498 B Thunder Mtn. Rd., Juneau, AK (US) 99801

( * ) Notice: Subject to any disclaimer, the term of this patent is extended or adjusted under 35 U.S.C. 154(b) by 32 days.

(21) Appl. No.: 10/121,569

(22) Filed: Apr. 12, 2002

(65) Prior Publication Data

US 2003/0192906 A1 Oct. 16, 2003

(51) Int. Cl.[7] ..... A47F 1/04; G07F 11/16

(52) U.S. Cl. ..... 221/311; 221/267; 221/279; 221/155; 221/191; 221/280

(58) Field of Search ..... 221/267, 309, 221/280, 311, 279, 155, 185, 303, 312 R, 312 L; 224/196, 191

(56) References Cited

U.S. PATENT DOCUMENTS 570,859 A * 11/1896 Weigand ..... 221/279
666,966 A * 1/1901 Mabee ..... 221/139
1,739,780 A * 12/1929 Buhrke ..... 221/281
3,800,981 A * 4/1974 Zeller ..... 221/198
3,840,149 A * 10/1974 Zeller ..... 221/199
4,889,260 A * 12/1989 Zeller ..... 221/197

* cited by examiner

*Primary Examiner*—Donald P. Walsh
*Assistant Examiner*—Kaitlin Joerger

(57) ABSTRACT

A golf tee holder and dispenser in a rectangular form holds a vertical stack of tees lying one on another horizontally, with successive tees alternating the orientation of their heads and their points. The golf tee holder and dispenser housing includes inner chambers that encase springs that allow straight-line movement as well as an inner center chamber to prevent tees from becoming disarranged while dispensing. A pusher plate maintains even pressure from dual spring movement against a snub point to hold golf tees in a stationary position until release through a top aperture using a teeter action once a downward pressure is applied to small end of tee by user. A molded element that has a memory retentive factor allows user to attach golf tee holder and dispenser to belt, pocket, golf bag, or golf cart.

16 Claims, 2 Drawing Sheets

GOLF TEE HOLDER AND DISPENSER

BACKGROUND OF THE INVENTION

The game of golf has become increasingly popular as a recreational sport today. However, golf is a difficult and often somewhat frustrating game. As a part of the game, most golfers typically tend to break tees while teeing off, which is at the beginning of every hole while playing either nine or eighteen holes of golf.

Many golfers typically like to keep extra golf tees, et cetera, on their person so they will have a golf tee within easy reach when needed instead of having to dig through their golf bag every time a golf tee, et cetera, is needed. Typically, the simplest place for golfers to keep extra tees, et cetera, is in their pants pocket.

The problem with carrying such accessories in one's pockets with tees, et cetera, is not very comfortable, as loading such accessories into pockets generally makes loose clothing tighter and tight clothing even tighter and somewhat restrictive and bulky. The accessories also can shift as the user moves, which can disrupt the swinging motion of the golfer, disrupting his/her shot. Further, with the golfer constantly needing to reach into the pockets of his or her pants to pull out a new tee, et cetera, and the golfer's pants tend to be dirtied by dirty hands. It is also not easy to remove such items from pockets while wearing a glove on one hand. Further, while tees, et cetera, are not especially sharp, such accessories are pointed and can injure the fingers, hand, et cetera, of the golfer as the golfer reaches into a pocket and can also poke or jab the legs of the golfer while in the golfer's pockets. Also, today's world of marketing has brought out colored tees, which when carried in one's pockets, may stain one's garments from dyes used.

Accordingly, a need exists for a golf tee, et cetera, holder that is mountable to belt or pocket or golf bag and cart of users, to expedite the game and save time searching for accessories. This invention, in turn, enables tees, et cetera, to be readily and quickly accessible to the golfer at all times.

A variety of devices have been developed to overcome these shortcomings. In U.S. Pat. No. 5,775,538, Covington describes a golf tee holder that enables carrying of tees for easy dispensing.

Known prior art includes U.S. Pat. No. 5,775,538; 4,889,260; 1,739,780; and 2,747,768.

While these devices fulfill their respective particular objectives and requirements, the aforementioned patents do not disclose a new golf tee holder and dispenser. The inventive device of Covington serves a genuine purpose, but does not enable golfer to have access to tees on side without noise and movement constriction. Zeller's invention needs another cartridge to be purchased for access to more tees. Also on Zeller's invention, the cost of manufacturing would prohibit the meeting of a market demand. Buhrke's invention has stationary springs and dispensing through the bottom which could cause accidental loss of tees.

In these respects, the tee holder and dispenser accordingly to the present inventions, substantially departs from the conventional concepts and design of the prior art, and in so doing, provides an apparatus primarily developed for the purpose of holding and dispensing of golf tees, to be worn by user or can be attached to golf bag or golf cart.

SUMMARY OF THE INVENTION

The present invention relates to a tee holder and dispenser that may be carried on the user's belt or golf bag or golf cart in ready position. The tee holder and dispenser consists of rectangular formed plastic or wood, being of general size of a personal pager. The tee holder and dispenser has dual spring members held in place from formed front and pack panels to continually urge a pusher plate upward toward an aperture, with a snub which, in turn, enables teeter dispensement from user's command of downward pressure on small end of tee at the top of the tee holder. The holder and dispenser is designed to hold a plurality of golf tees in a vertical stack of tees, lying one on another horizontally, with successive tees alternating the orientation of their heads and their points. Tees are loaded from aperture at top with downward pressure against the spring pressure within the tee holder and dispenser. A molded member of tee holder and dispenser allows attachment to user's waist or pocket, and to user's golf bag or cart.

Therefore, it is an object of the present invention to provide a tee holder and dispenser for easy access and dispensing of golf tees.

It is yet further an object of the present invention to provide a golf tee holder and dispenser that provides a space for advertising indicia.

An object of the invention is to provide a compact and convenient dispenser for golf tees.

A further object is to provide a way to attach the tee holder and dispenser to a golf bag and golf cart, as well as to the user's waist or pocket.

An object of this invention is to provide a holder and dispenser for golf tees that prohibits accidental loss of tees.

Finally, it is an object of the present invention to provide a golf tee holder and dispenser that is sturdy, durable, compact, light-weight, simple to use, safe, attractive and reliable in operation, yet is inexpensive and easy to manufacture, install, and maintain.

Figure 1:
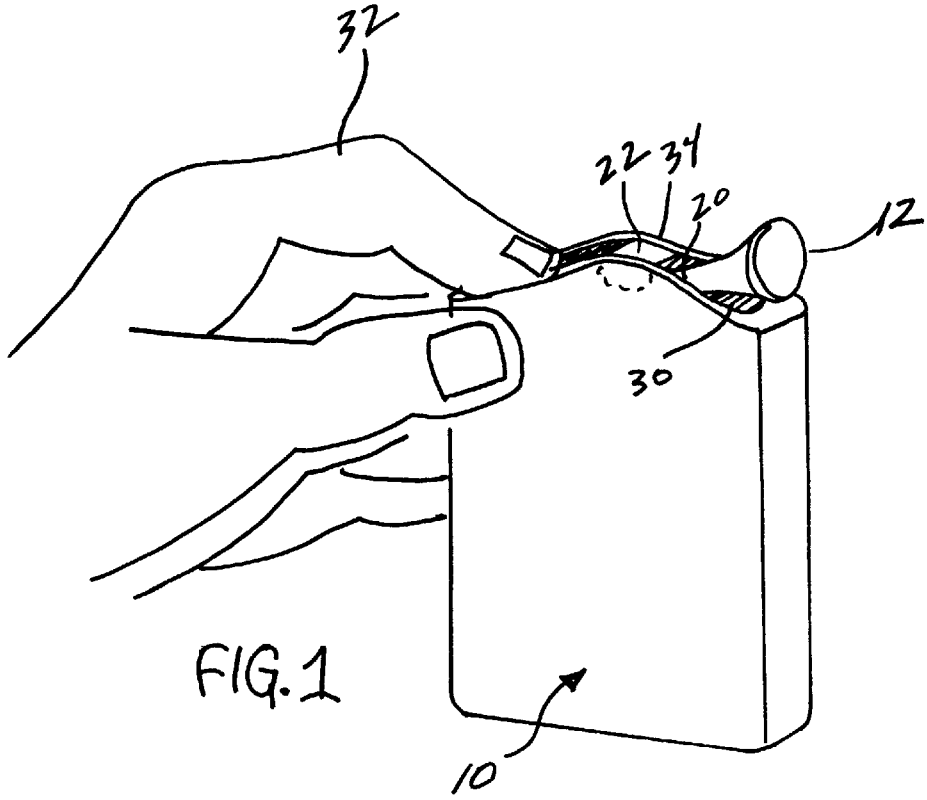
FIG. 1 is a perspective front view of preferred embodiment of the golf tee holder and dispenser showing user applying downward pressure or small end of tee to activate teeter motion for removal of golf tee.

As an aid in correlating the terms of the claims to the exemplary drawings, the following catalogue of elements is provided:

10—Holder and dispenser
12—Golf tee head
14—Golf tee point
16—Compression spring
18—Compression spring
20—Golf tee shank
22—Snub

24—Viewing window
26—Memory retentive clip
28—Pusher plate
30—Aperture
32—User
34—Attachment means
36—Inner chamber
38—Back panel
40—Front panel

DETAILED DESCRIPTION OF THE PREFERRED EMBODIMENT

With reference now to the drawings, and in particular to FIGS. 1 through 5 thereof, a new golf tee holder and dispenser embodying the principals and concepts of the present invention and generally designated by the reference numeral (10) will be described.

Referring to FIG. 1, the tee holder and dispenser (10) is preferably constructed from suitable rigid substance in the form of a container having a memory retentive clip (26) integrally formed thereon. The holder and dispenser (10) is a rectangular shaped formation having a front panel (40) and back panel (38) connected by attachment means (34). The top portion of the holder and dispenser (10) has a formed aperture (30) to allow dispensing of golf tees by applying downward pressure from user (32) on the golf tee point (14) causing a teeter affect from placement of snub (22) allowing user (32) to extract golf tee by pulling golf tee by golf tee head (12).

Figure 2:
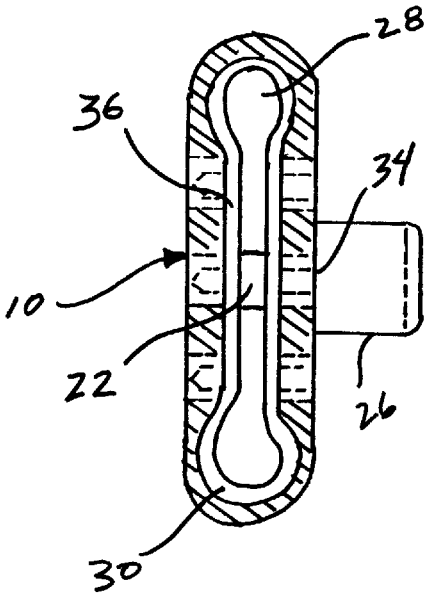
FIG. 2 is a top view of preferred embodiment showing top aperture and pusher plate; also shown is snub positioning and top view of molded element attached to preferred structure or figure. Also shown is molded form to hold springs and showing inner chamber to prevent disarrangement of tees.

FIG. 2 shows top view of holder and dispenser (10) showing aperture (30) having dimensions on outer ends slightly larger to encase compression springs (16) (18) that encourage straight-line movement. Inner chamber (36) of aperture (30) connecting outer ends of aperture (30) is elongated at dimensions slightly larger than tee shanks (20) to prevent misalignment of vertical stack of tees. In FIG. 2, the snub (22) allows teeter movement described in FIG. 1 and a stopping point for pusher plate (28) if current dispenser (10) is empty or for golf tees when loaded. Pusher plate (28) is slightly smaller in dimension than aperture (30) of holder and dispenser (10). Top view of memory retentive clip (26) is shown in FIG. 2.

Figure 3:
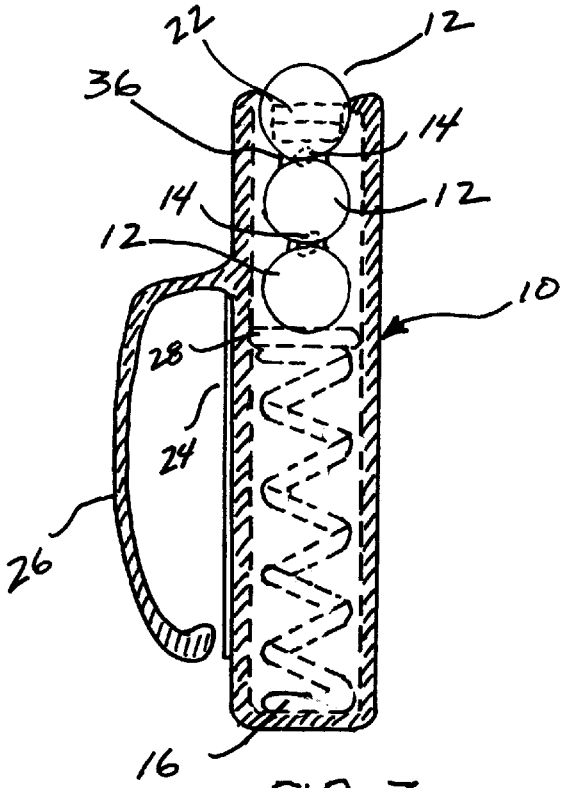
FIG. 3 is a vertical cross section showing placement of inner moving parts and showing molded clip that allows expansion for different thickness of object to which golf tee holder and dispenser is attached.

FIG. 3 is a cross side view of holder and dispenser (10) showing golf tees (12) stacked in array position. Also showing side view of memory retentive clip (26) showing in relaxed position. Memory retentive clip (26) is designed to allow maximum expansion to clamp over top of a golf bag as well as clamp on golf cart. Memory retentive clip (26) has nib on end to prevent holder and dispenser (10) from slipping off of user's belt or pants from any bending or twisting action of user (32). Pusher plate (28) has dual action from dual compressions springs (16)(18) to push upward to hold golf tees in locked position against snub (22) located at apex of holder and dispenser (10). Golf tee shank (20) is surrounded by molded inner chamber (36) from the attachment of the back panel (38) and the front panel (40).

Figure 4:
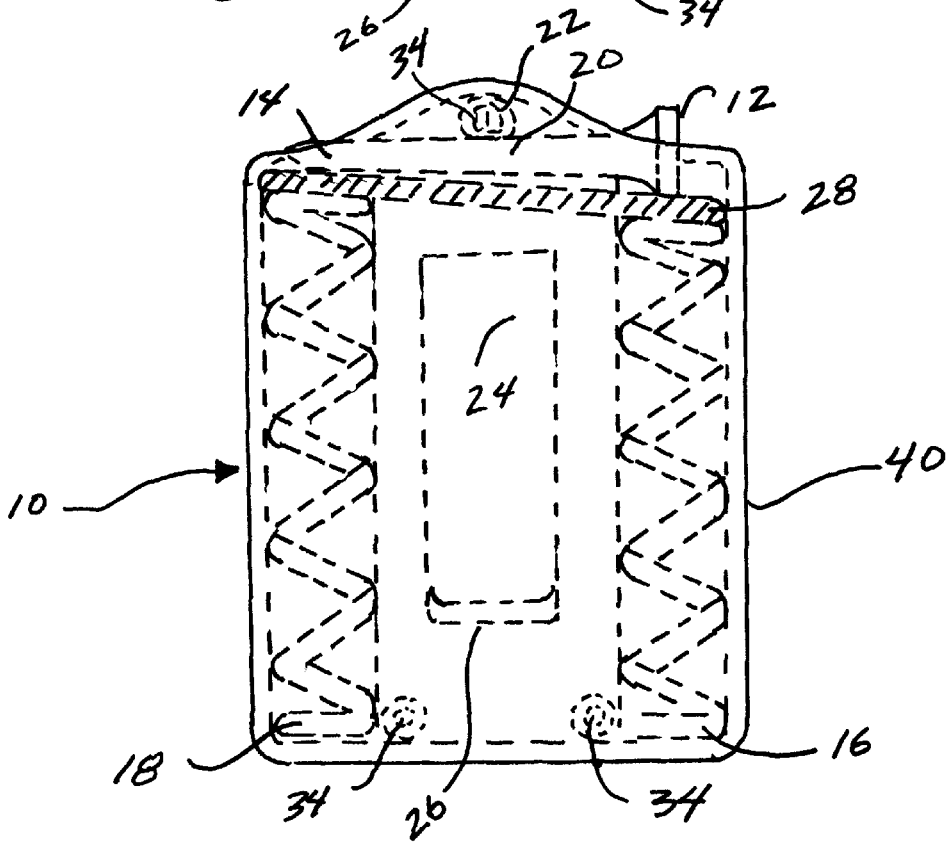
FIG. 4 is a cutaway front view showing inner parts in operating form.

FIG. 4 is a perspective back view of holder and dispenser (10) showing compression springs (16)(18) in true vertical alignment due to molded shape of front panel (40) and back panel (38). Also shown is viewing window (24) that allows user to view how many golf tees are present in holder and dispenser (10). FIG. 4 reveals golf tees that have been loaded into holder and dispenser (10) by inserting each through aperture (30) and depressing to enable entry of the next succeeding golf tee. In this case, golf tees constitute the full capacity, although different lengths of golf tees may be accommodated due to placement of snub (22) in apex of holder and dispenser (10).

Figure 5:
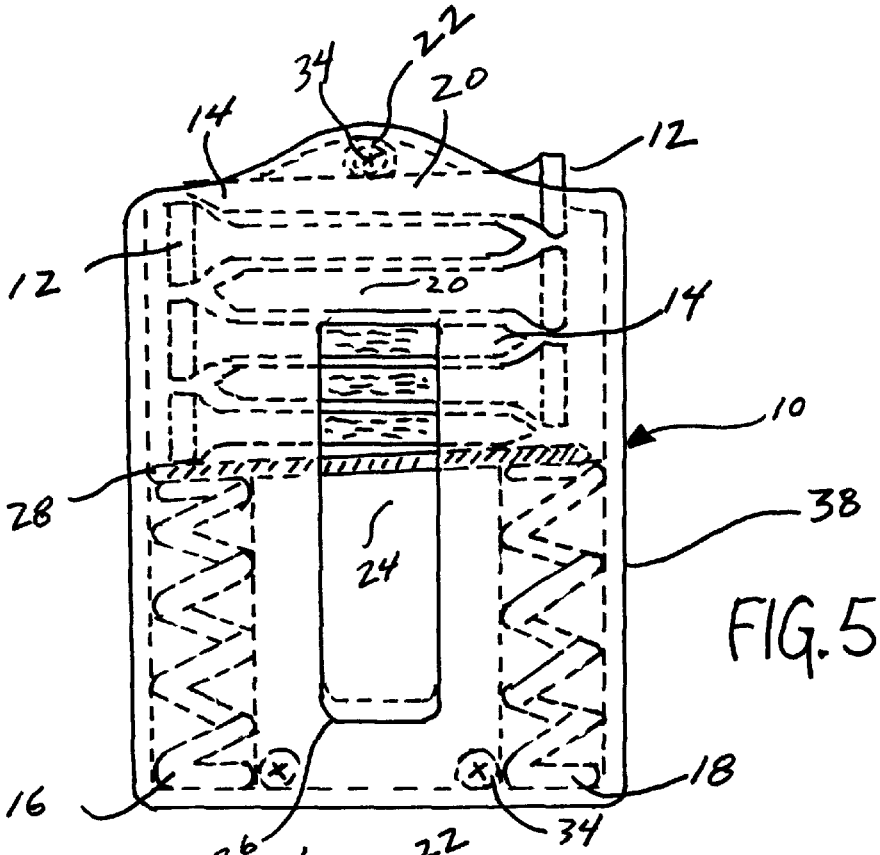
FIG. 5 is a cutaway back view showing inners parts in operating form.

FIG. 5 is a front perspective view of the holder and dispenser (10) showing how compression spring (16)(18) apply even pressure to pusher plate (28). This action is needed for the dimension size differs in golf tees between the golf tee head (12) and golf tee point (14) to allow snub (22) to hold the golf tee in stationary position from golf tee shank (20). Shaping of holder and dispenser (10) has been designed to prevent golf tees from falling out of aperture (30) by the positioning of the snub (22) at the apex of the holder and dispenser (10). To dispense a golf tee, the user (32) need only to apply downward pressure on golf tee point (14) of top golf tee to activate a teeter effect caused from golf tee shank (20) hitting against snub (22) on apex of holder and dispenser (10) allowing user (32) to extract golf tee by grasping golf tee head (12) and pulling out. If user (32) decides to reload, user (32) inserts golf tee point (14) underneath snub (22) and pushes downward on golf tee head (12) to allow pusher plate (28) to compress against compression springs (16)(18) which, in turn, allows golf tee to load into position until next extraction.

The foregoing discloses a novel, compact golf tee holder and dispenser, and organizer that may be carried in an accessible position to dispense golf tees quickly for user. A plurality of such golf tees may be placed in spring loaded stowage for individual extraction and thereby eliminates user from searching for golf tees. The golf tee holder and dispenser is constructed in accordance with the present inventor contributing to greater user safety through orderly storage and dispensing of golf tees.

Changes may be made in the combination and arrangement of elements as heretofore set forth in the specifications and shown in the drawings; it being understood that changes may be made in the embodiments disclosed without departing from the spirit and scope of the invention as defined in the following claims.

What is claimed is:

1. A golf tee holder and dispenser, comprising:

said holder and dispenser being of length to accommodate a plurality of golf tees in stacked relation vertically lying one on another horizontally with successive tees alternating the orientation of heads and points;

a pusher plate;

dual springs based inside of said holder and dispenser arranged to align said pusher plate upward into supporting contact with a lowermost tee to push the stack of tees upwardly in said holder and dispenser;

a dispensing aperture at a top of said holder and dispenser;

said aperture being larger in dimension than golf tees being contained therein, but slightly smaller than said pusher plate;

said holder and dispenser having a flat surface which allows ease of imprinted advertising indicia; and said holder and dispenser having a curved surface adjacent said dispensing aperture, with said dispensing aperture being of size to permit application of the force of a user's finger against a topmost golf tee point downward and toward said dispensing aperture to effect release of the topmost golf tee from said stack through said dispensing aperture.

2. The golf tee holder and dispenser according to claim 1, further comprising a snub point situated adjacent the curved surface that inhibits upward movement of golf tees and allows a teeter action of golf tees when said user applies said force.

3. The golf tee holder and dispenser according to claim 1, further comprising a memory retentive clip situated on a back panel of said holder and dispenser.

4. The golf tee holder and dispenser according to claim 3, wherein the memory retentive clip covers a portion of a viewing window to permit said user to determine a remaining number of golf tees in the golf tee holder and dispenser.

5. The golf tee holder and dispenser according to claim 3, wherein the memory retentive clip has an inward curved lip.

6. The golf tee holder and dispenser according to claim 1, comprising an inner chamber with dimension slightly larger than golf tee shanks to prevent misalignment of golf tees in upward and downward motion.

7. The golf tee holder and dispenser according to claim 6, further comprising circular ends on said inner chamber which have slightly larger dimensions to accept golf tee heads in said stack.

8. A golf tee holder and dispenser, comprising:

said holder and dispenser being of length to accommodate a plurality of golf tees in stacked relation vertically lying one on another horizontally with successive tees alternating the orientation of heads and points;

a pusher plate;

a spring mechanism inside of said holder and dispenser arranged to align said pusher plate upward into supporting contact with a lowermost tee to push the stack of tees upwardly in said holder and dispenser;

a dispensing aperture at a top of said holder and dispenser;

said aperture being larger in dimension than golf tees being contained therein, but slightly smaller than said pusher plate; and said holder and dispenser having a curved surface adjacent said dispensing aperture, with said dispensing aperture being of size to permit application of the force of a user's finger against a topmost golf tee point downward and toward said dispensing aperture to effect release of the topmost golf tee from said stack through said dispensing aperture.

9. The golf tee holder and dispenser according to claim 8, further comprising a snub point situated adjacent the curved surface that inhibits upward movement of golf tees and allows a teeter action of golf tees when said user applies said force.

10. The golf tee holder and dispenser according to claim 8, further comprising a memory retentive clip situated on a back panel of said holder and dispenser.

11. The golf tee holder and dispenser according to claim 10, wherein the memory retentive clip covers a portion of a viewing window to permit said user to determine a remaining number of golf tees in the golf tee holder and dispenser.

12. The golf tee holder and dispenser according to claim 10, wherein the memory retentive clip has an inward curved lip.

13. The golf tee holder and dispenser according to claim 10, comprising an inner chamber with dimension slightly larger than golf tee shanks to prevent misalignment of golf tees in upward and downward motion.

14. The golf tee holder and dispenser according to claim 13, further comprising circular ends on said inner chamber which have slightly larger dimensions to accept golf tee heads in said stack.

15. The golf tee holder and dispenser according to claim 8, wherein the spring mechanism comprises a pair of springs.

16. The golf tee holder and dispenser according to claim 8, wherein said holder and dispenser has a flat surface which allows ease of imprinted advertising indicia.

* * * * *